US006925757B2

(12) United States Patent
Priest et al.

(10) Patent No.: US 6,925,757 B2
(45) Date of Patent: Aug. 9, 2005

(54) CABLE DRIVE ASSEMBLY

(75) Inventors: William L. Priest, Royal Oak, MI (US); Kevin Wright, Detroit, MI (US); Mark D. Nicholas, Waterford, MI (US); Theodore J. Lindsay, Utica, MI (US)

(73) Assignee: Delphi Technologies, Inc., Troy, MI (US)

( * ) Notice: Subject to any disclaimer, the term of this patent is extended or adjusted under 35 U.S.C. 154(b) by 104 days.

(21) Appl. No.: 10/423,554

(22) Filed: Apr. 25, 2003

(65) Prior Publication Data

US 2004/0065017 A1 Apr. 8, 2004

Related U.S. Application Data

(60) Provisional application No. 60/415,582, filed on Oct. 2, 2002.

(51) Int. Cl.[7] ..... E05F 11/53
(52) U.S. Cl. ..... 49/360; 242/388.8
(58) Field of Search ..... 49/360, 352, 348; 242/388.6, 388.8

(56) References Cited

U.S. PATENT DOCUMENTS

| | | | | | |
|---|---|---|---|---|---|
| 4,534,233 | A | * | 8/1985 | Hamaguchi | 74/89.2 |
| 4,577,439 | A | * | 3/1986 | Seki | 49/352 |
| 4,644,694 | A | * | 2/1987 | Ujihara | 49/352 |
| 5,046,283 | A | * | 9/1991 | Compeau et al. | 49/138 |
| 5,138,795 | A | * | 8/1992 | Compeau et al. | 49/138 |
| 5,316,365 | A | * | 5/1994 | Kuhlman et al. | 296/155 |
| 5,319,880 | A | | 6/1994 | Kuhlman | |
| 5,319,881 | A | | 6/1994 | Kuhlman | |
| 5,323,570 | A | * | 6/1994 | Kuhlman et al. | 49/360 |
| 5,396,158 | A | | 3/1995 | Long et al. | |
| 5,857,635 | A | * | 1/1999 | Klippert | 242/407 |
| 5,992,919 | A | * | 11/1999 | Menke | 296/155 |
| 6,038,818 | A | * | 3/2000 | Haag et al. | 49/360 |
| 6,092,336 | A | | 7/2000 | Wright et al. | |
| 6,179,742 | B1 | | 1/2001 | Haag et al. | |
| 6,231,113 | B1 | * | 5/2001 | Armbruster et al. | 296/155 |
| 6,367,864 | B2 | | 4/2002 | Rogers, Jr. et al. | |
| 6,390,535 | B1 | | 5/2002 | Chapman | |
| 6,561,569 | B1 | | 5/2003 | Risdon et al. | |
| 6,612,198 | B2 | | 9/2003 | Rouleau et al. | |
| 2003/0062439 | A1 | | 4/2003 | Priest et al. | |
| 2004/0065018 | A1 | * | 4/2004 | Regnier et al. | 49/352 |

FOREIGN PATENT DOCUMENTS

| | | |
|---|---|---|
| DE | 2932295 | 2/1981 |
| DE | 4113391 | 7/1991 |
| WO | WO 02/102615 A2 | 6/2002 |

OTHER PUBLICATIONS

European Search Report for European Application No. EP 03077837.

* cited by examiner

*Primary Examiner*—Gregory J. Strimbu
(74) *Attorney, Agent, or Firm*—Scott A. McBain

(57) ABSTRACT

A cable drive assembly for opening and closing a sliding vehicle door has first and second drums that are drivingly connected to each other via a tension spring that biases the drums in opposite directions. The drums include a catch that holds the first and second drums in a cocked condition where the spring is tensioned to provide slack in a closed loop cable to facilitate inserting a traveler attached to the cable into a track. The cocked drums are manually rotated in a drum housing in one direction to move the traveler and insert it into the track. After the traveler is inserted, the cocked drums are manually rotated in the opposite direction. This releases the catch so that the tensioned spring takes up the slack in the closed loop cable.

12 Claims, 3 Drawing Sheets

CABLE DRIVE ASSEMBLY

RELATED APPLICATION

This patent application claims benefit of U.S. Provisional patent application 60/415,582 filed Oct. 2, 2002.

TECHNICAL FIELD

This invention relates generally to a power operated sliding door closure system for opening and closing a sliding door on a vehicle and more particularly to a cable drive assembly for such a system.

BACKGROUND OF THE INVENTION

Van type vehicles for passengers and for cargo are frequently equipped with sliding side doors. Many vans include a single sliding door on the passenger side of the van. However, the van may be equipped with sliding doors on both sides. Drivers and passengers can open or close sliding doors of this type manually from inside or outside of the vehicle. However, the sliding door is usually heavy and often inconvenient and/or difficult to move manually, particularly from inside the vehicle.

For convenience, power operated sliding door closure systems have been developed to allow drivers and passengers to open and close a sliding door virtually effortlessly. Moreover the sliding door usually can be opened or closed from the driver's seat and/or one or more other locations remote from the sliding door.

One type of power operated sliding door closure system, known as a "closed loop" system, is disclosed in U.S. Pat. No. 5,396,158 which issued Mar. 7, 1995 to Joseph D. Long et al. The Long et al. '158 patent discloses a power operated sliding door closure system in which a sliding door is mounted on a van by travelers that are slidably supported in upper, center and lower tracks. An opening and closing module is mounted inside the van adjacent the center track. A front cable is attached to a front cable drive pulley or drum and extends from the front drum to the traveler through a front cable roller guide assembly. A rear cable is attached to a rear cable drive pulley or drum and extends from the rear drum to the traveler through a rear cable roller guide assembly. The front and rear cable drive drums each have a large diameter helical cable groove.

A motor drive unit rotates the front and rear cable drive drums to move the sliding door. The motor drive unit, as best shown in FIG. 3 of the Long et al. '158 patent, comprises an electric motor that drives a drive gear that is coaxially aligned with the front and rear cable drive drums. A coil spring is seated in an annular opening in the cable drive drums. An upper spring end is anchored on the rear cable drive drum and a lower spring end is anchored on the front cable drive drum. The coil spring is a tension retaining spring that urges the front cable drive drum in the counterclockwise winding direction and the rear cable drive spool in the opposite clockwise winding direction so that the front and rear cables are maintained in tension at all times.

While the "closed loop" type of system disclosed in the Long et al. '158 patent is satisfactory for its intended purpose, assembly of the system may be difficult because of the tension retaining spring that takes up slack and insures that the front and rear cables are maintained in tension at all times. Considerable slack is often desired to facilitate assembly of the closed loop system because the traveler (roller hinge assembly shown at 26 in the Long et al. '158 patent) must be inserted into the track (usually the center track shown at 18 in the Long et al. '158 patent) after the ends of the front and rear cables are attached to the traveler. However, the coil spring in the system noted above, must be tensioned or wound up to provide any slack at all and even then the slack may not be enough to facilitate insertion of the traveler into one end of the track. Furthermore even with sufficient slack, the cables may not position the traveler correctly for insertion into the one end of the track.

Another way to take up slack in a "closed loop" system is disclosed in the U.S. Pat. Nos. 5,319,880 and 5,319,881 granted to Howard W. Kuhlman Jun. 14, 1994. These patents disclose a mechanical take-up device comprising a small cable slack take-up pulley 174 and a cooperating tooth rack 172 mounted on the cable pulley. One end of one of the cables is attached to the small cable slack take-up pulley. After both cables are attached to the traveler and the traveler is inserted into the track, the cable slack is taken up by rotating the small cable slack take-up pulley with a special tool. See also pending patent application Ser. No. 09/970,167 filed Oct. 3, 2001. The mechanical take up device facilitates assembly by allowing sufficient slack in the cables. However, the cables still may not position the traveler correctly. Moreover, the take-up device is complicated and expensive and requires a special tool for operation.

SUMMARY OF THE INVENTION

According to the invention, a cable drive assembly for a power operated sliding door closure system on a vehicle is provided that facilitates insertion of a traveler into a track and takes up slack in the cables attached to the traveler in an efficient and unique manner.

The drive assembly includes front and rear drums with helical front and rear cable grooves respectively that are supported for rotation about a longitudinal axis. A front cable extends from the front cable groove to a traveler attached to a vehicle sliding door in a position to be wound into and unwound from the front cable groove in response to front drum rotation in respective opposing directions about the longitudinal axis. A rear cable extends from the rear cable groove to the traveler for the sliding door in a position to be unwound from and wound onto the rear cable groove in response to rear drum rotation in respective opposing directions about the longitudinal axis. The cable drive unit also includes a spring that biases the front drum and the rear drum in opposite directions to maintain the front and rear cables in tension.

The front and rear drums are configured to provide a catch that holds the front and rear drums in a cocked condition where the spring is tensioned so that the cable purposely has slack to facilitate inserting the traveler into a track during assembly. The cocked drums are rotatable in a drum housing which has a catch release. The cocked drums are manually rotated in the drum housing in one direction, preferably by pulling on one of the cables, to move the traveler and position the traveler for insertion into one end of the track. After the traveler has been inserted into the track, the cocked drums are manually rotated in the drum housing in the opposite direction, preferably by pulling on the other cable. This operates the catch release in the drum housing which releases the catch holding the drums in the cocked condition. When released, the spring rotates the drums relative to each other and takes up the slack in the cables.

BRIEF DESCRIPTION OF THE DRAWINGS

These and other features and advantages of the invention will become apparent to those skilled in the art in connection with the following detailed description and drawings, in which.

DETAILED DESCRIPTION OF THE PREFERRED EMBODIMENT

Figure 1:
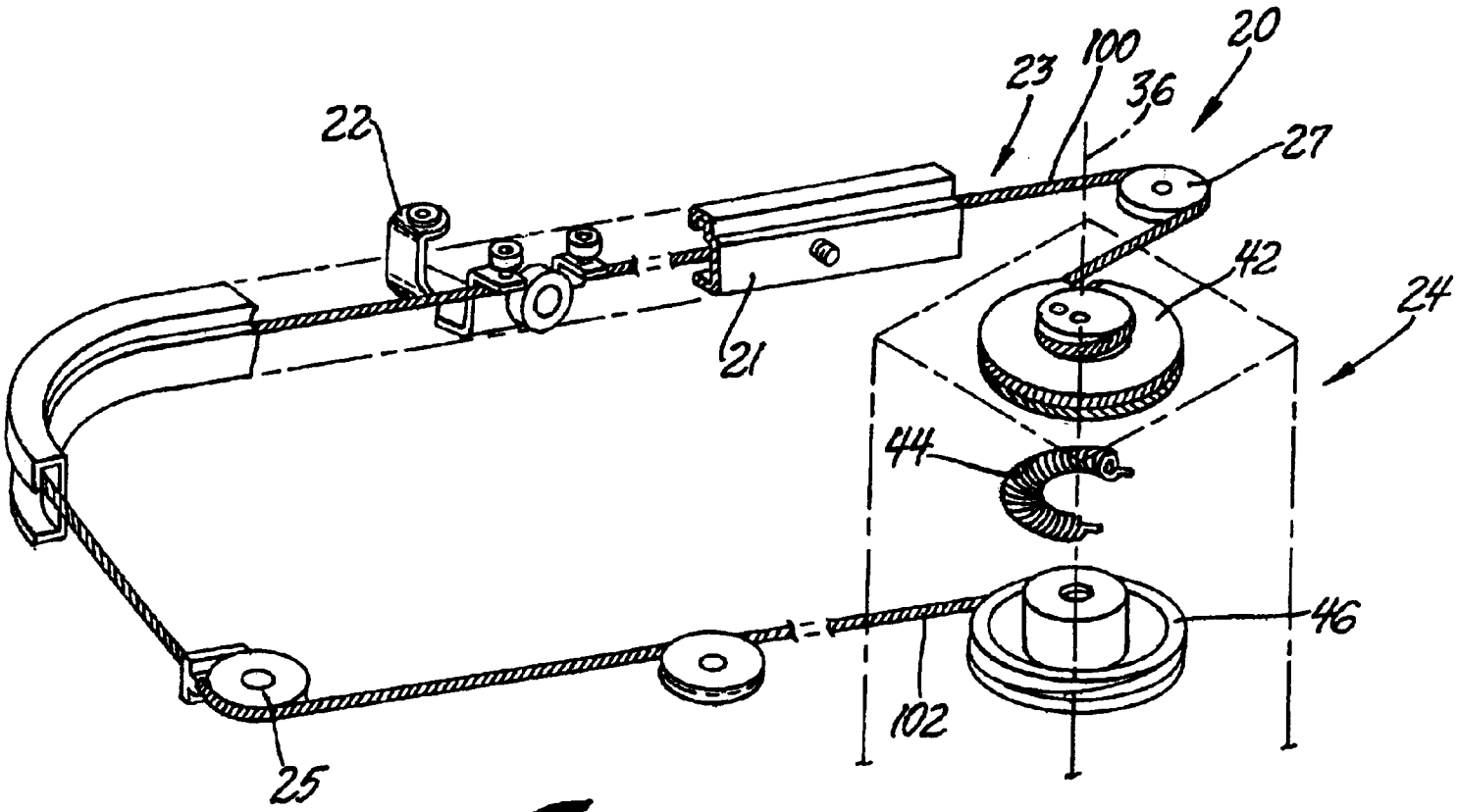
FIG. 1 is a schematic perspective view of a power operated sliding door closure system having a cable drive assembly constructed according to the invention.

A closed loop power operated sliding of a door closure system for opening and closing a sliding door on a vehicle is generally shown at 20 in FIG. 1. In FIG. 1 the system 20 is shown configured to be installed in a van that includes a sliding door supported on a plurality of tracks mounted on a vehicle frame, typically a top track, a bottom track and a center track. The system 20 includes a traveler, shown at 22 in FIG. 1, that connects the closure system 20 to the sliding door (not shown). The door closure system moves the sliding door and traveler 22 along one of the tracks, usually the center track shown at 21 in FIG. 1, between a closed position and an open position. The closed loop cable closure system 20 is mounted on the vehicle frame and includes a cable drive assembly 24.

The cable drive assembly 24 constructed according to the invention may be used in a closed loop cable closure system 20 such as that described in U.S. Pat. No. 5,396,158 which is described above and incorporated herein by reference.

Figures 2, 3, 7:
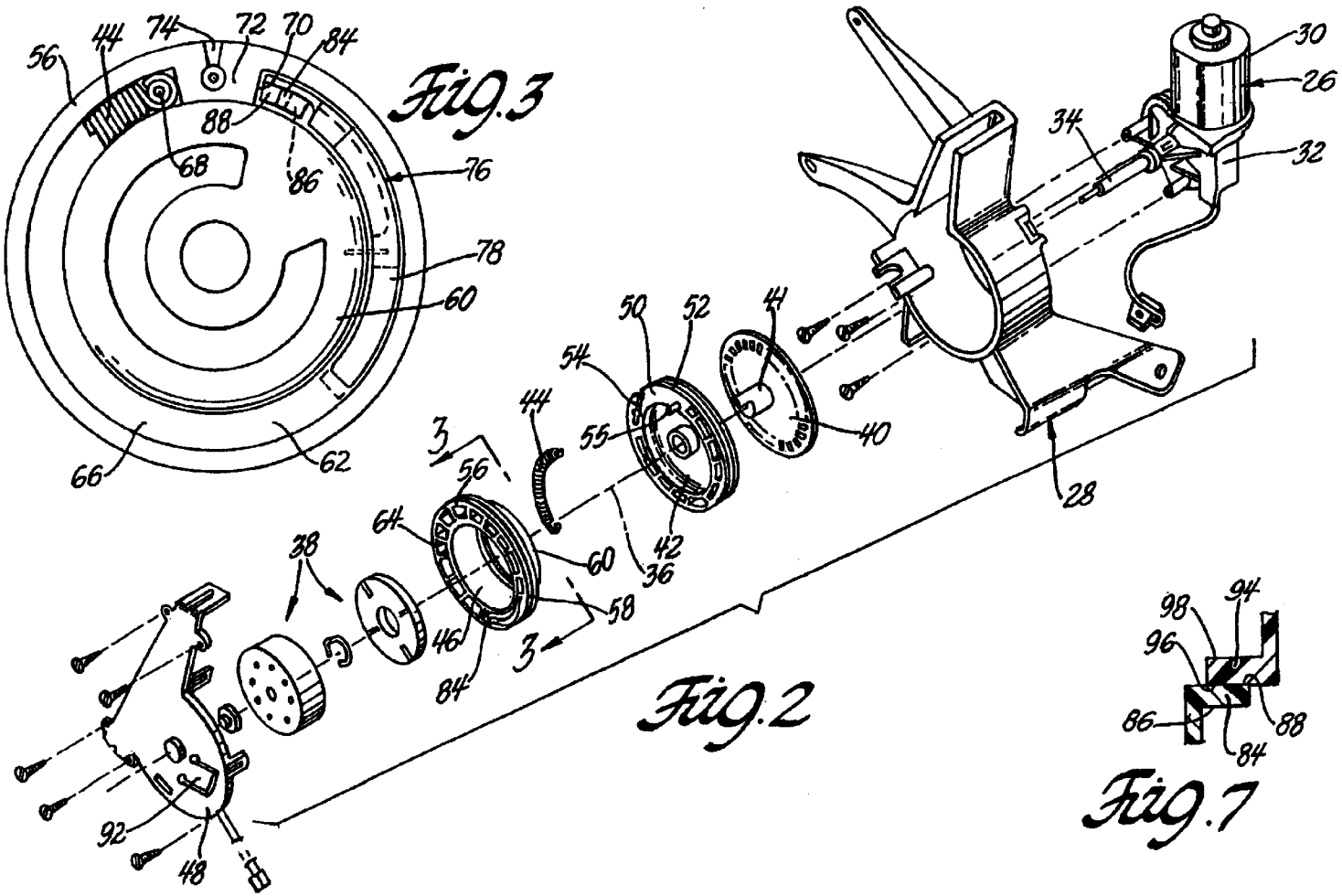
FIG. 2 is an exploded perspective view of a cable drive assembly constructed according to the invention.
FIG. 3 is an opposite end view of one of the cable drums shown in FIG. 2.
FIG. 7 is a section taken substantially along the line 7—7 of FIG. 5 looking in the direction of the arrows.

Referring now to FIG. 2, the cable drive assembly 24 comprises a motor sub-assembly 26 that is attached to the exterior of a housing 28. Motor sub-assembly 26 includes a reversible electric motor 30 that drives a reduction gear unit 32 that has an output shaft 34. Output shaft 34 extends into housing 28 on a longitudinal axis 36 to drive an electromagnetic clutch indicated generally at 38. Electromagnetic clutch 38 is disposed inside housing 28 along with an interrupter 40, a front drum 42, a tension spring 44, and a rear drum 46. Housing 28 is closed by a cover 48.

Interrupter 40 comprises a plate having an integral annular sleeve 41 that is journalled on shaft 34 for concentric rotation about shaft 34 and longitudinal axis 36. Sleeve 41 extends through respective bores of front and rear drums 42, 46 and supports the front and rear drums 42, 46 rotationally on axis 36. The free end of sleeve 41 attaches to a friction output plate of electromagnetic clutch 38. The plate of the interrupter 40 has a plurality of circumferentially spaced windows that cooperate with an optical sensor (not shown) to determine the speed and location of the van door (not shown) in the opening and closing operations. The output shaft 34 of the motor sub-assembly 26 extends through annular sleeve 41 of the interrupter 40 and drives the input member of the electromagnetic clutch 38. Electromagnetic clutch 38 operates in a conventional manner to drive the friction plate of the electromagnetic clutch 38 when energized while allowing free rotation of the friction plate when deenergized. This facilitates manual operation of the van door by eliminating the necessity to back drive electric motor 30.

Front drum 42 is cup shaped having an end wall with a large diameter rim 50 that includes a helical front cable groove 52 and a cable anchor slot 54 in rim 50 that communicates with the front cable groove 52 as best shown in FIG. 2. Front drum 42 has an integral pin shaped lug 55 that extends from rim 50 in an axial direction. Lug 55 serves as a spring anchor and as well as a catch lug as explained below.

Rear drum 46 is also cup shaped having a large diameter outer rim 56 that includes a helical rear cable groove 58 and a reduced diameter hub 60. A radial wall 62 and radial ribs 64 connect rim 56 to hub 60. The radial ribs 64 are on one side of wall 62. The space between rim 56 and hub 60 on the other side of wall 62 provides an annular spring chamber 66 of about 350° as best shown in FIG. 3. Chamber 66 has a pin shaped spring anchor lug 68 at one end and a fixed stop 70 at the other end. Stop 70 is part of a trapezoidal lug 72 of about 10° that fills the space between rim 56 and hub 60. Lug 72 also provides a cable anchor slot 74.

Rear drum 46 includes a spring catch 76 comprising an accurately shaped, flexible cantilever arm 78 attached to an end of radial wall 62. Catch 76 includes a moveable stop face 80 near the free end of flexible arm 78 and a ramp 82 leading up to stop face 80 from a point closer to the fixed end of the flexible arm 78. Catch 76 also has a cam follower 84. Cam follower 84 is bidirectional having inner and outer cam follower surfaces 86 and 88 that are ramped at opposite ends resulting in a diamond or parallelogram like shape for the follower 84. The cam follower 84 is attached to the free end of the flexible arm 78 at one side so that the entire peripheral surface of the cam follower 84 that provides the cam follower surfaces 86 and 88 is engageable by a cam as explained below.

Figure 4:
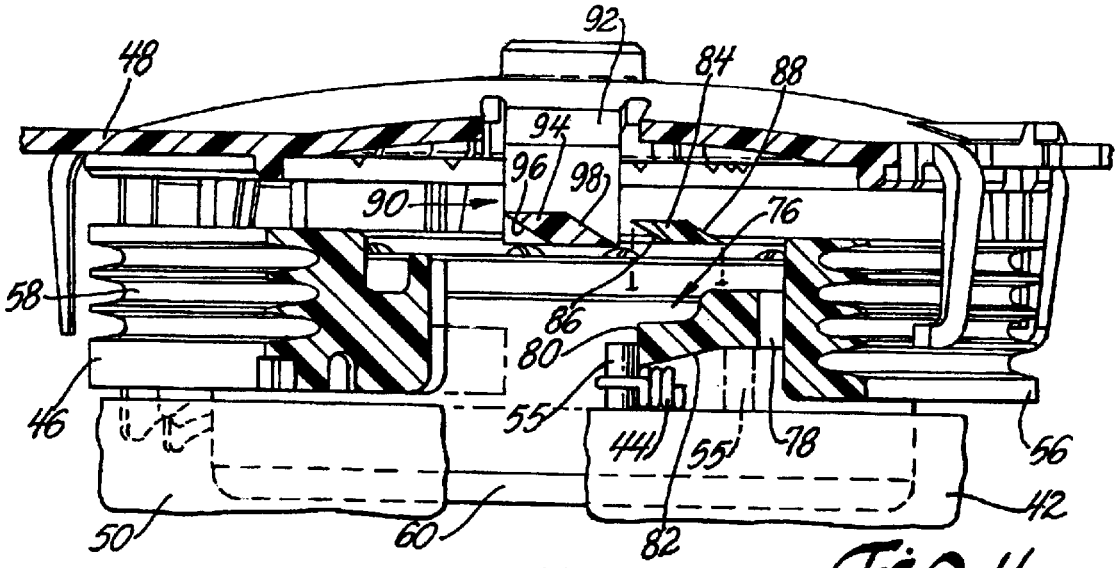
FIG. 4 is a section of the cable drive assembly showing the cable drums, in a cocked position.

Rear drum 46 is partially nested in front drum 42 with its rim 50 juxtaposed rim 56 as best shown in FIG. 4. Tension spring 44 is disposed in spring chamber 66 with one end attached to spring anchor lug 55 and the other end attached to spring anchor lug 68. When in tension, tension spring 44 biases front drum 42 counterclockwise and rear drum 46 clockwise as viewed in FIG. 2.

Tension spring 44 is pre-tensioned by rotating front drum 42 clockwise with respect to rear drum 46 until spring anchor lug 55 engages ramp 82 as shown in phantom in FIG. 4 and then continues along the ramp 82 until it snaps behind stop face 80 of spring catch 76 as shown in solid line in FIG. 4. Drums 42 and 46 are now in a cocked condition. Stop 70 of lug 72 limits further clockwise rotation. Cocked drums 42 and 46 are disposed inside housing 28 which has a catch release 90 attached to cover 48.

Catch release 90 comprises a flexible strip 92 of cover 48 which supports a cam 94. Cam 94 is bidirectional having inner and outer cam surfaces 96 and 98 that are ramped at opposite ends resulting in a diamond or parallelogram like shape for the cam 94. Cam 94 is attached to the flexible strip 92 at one side so that the entire peripheral surface of cam 94 that provides cam surfaces 96 and 98 is engageable by cam follower 84 as shown in FIG. 7 and further explained below.

Front and rear cables 100 and 102 shown in FIG. 1, are anchored in drums 42 and 46 respectively and wound in opposite circumferential directions around the respective drums 42 and 46. Cables 100 and 102 extend from the respective drums 42 and 46 in the opposite tangential directions and out respective exits of housing 28. In operation, front cable 100 wraps onto front drum 42 while rear cable 102 unwraps from rear drum 46 and vice-versa.

The front cable 100 extends from the front cable groove of drum 42 to the sliding door traveler 22 in a position to be wound onto the drum 42 and into the front cable groove in response to front drum 42 and front cable groove rotation about the longitudinal axis 36 in a forward direction (counterclockwise as shown in FIG. 1) which closes the sliding door of the van (not shown). When the drum 42 and front cable groove rotate in a reverse or clockwise direction, opposite the forward direction to open the sliding door, the front cable 100 winds off of the drum 42 and out of the front cable groove.

Similarly, the rear cable 102 extends from the rear cable groove to the sliding door traveler 22 in a position to be wound off of the drum 46 from the rear cable groove in response to drum 46 and rear cable groove rotation about the longitudinal axis 36 in the forward or counterclockwise direction which closes the sliding door. When the drum 46 and rear cable groove rotate in the reverse or clockwise direction to open the sliding door, the rear cable 102 winds onto the drum 46 into the rear cable groove.

The cable drive assembly 24 with cables 100 and 102 is manufactured at one location and then delivered to an assembly plant where it is attached to a vehicle so as to become a part of the power operated sliding door closure system shown in FIG. 1.

In initial steps of the assembly process, cable drive assembly 24 is attached to a vehicle and cables 100 and 102 are attached to the traveler 22. Traveler 22 must then be inserted into the guide track 21 which has already been attached to the vehicle as part of the body build.

When attached to the vehicle, cable drive assembly 24 is in the cocked condition which provides slack in cables 100 and 102 to facilitate insertion of traveler 22 into guide track 21. However, traveler 22 may not be positioned correctly for insertion into the end of the guide track 21. For instance, the traveler 22 should be positioned at 23 as shown in FIG. 1 whereas traveler may be positioned a few feet away from this ideal location.

Figure 5:
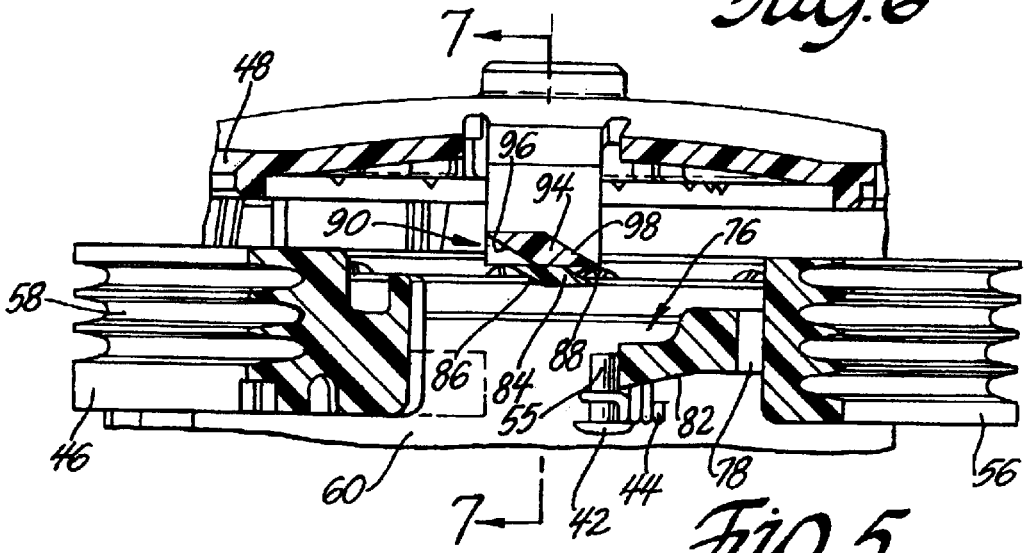
FIG. 5 is a section similar to FIG. 4 showing the cocked cable drums being rotated in the cable drum housing in a first direction to position a traveler for insertion into the end of a guide track.

Traveler 22 can be moved to the ideal location at 23 easily because of the bidirectional nature of cam 94 and cam follower 84. The cocked drums 42 and 46 are simply rotated relative to the housing 28 in the proper direction as shown in FIG. 5. When the cocked drums 42 and 46 are rotated in this direction, catch 76 is not released. When catch 76 approaches catch release 90 from the right as shown in FIG. 5, inner cam surface 96 of cam 94 engages outer cam follower surface 88 of cam follower 84. This simply raises cam 94 and/or pushes catch 76 deeper into spring chamber 66. In either event, catch lug 55 is held in the cocked position of FIG. 4 by spring catch 76.

Traveler 22 is moved to the ideal location, preferably by pulling cable 102 to rotate the cocked drums 42 and 46 in the proper direction. Traveler 22 is then inserted into guide track 21. The cables 100 and 102 are then properly located on any guide pulleys, such as guide pulleys 25 and 27 shown in FIG. 1.

Figure 6:
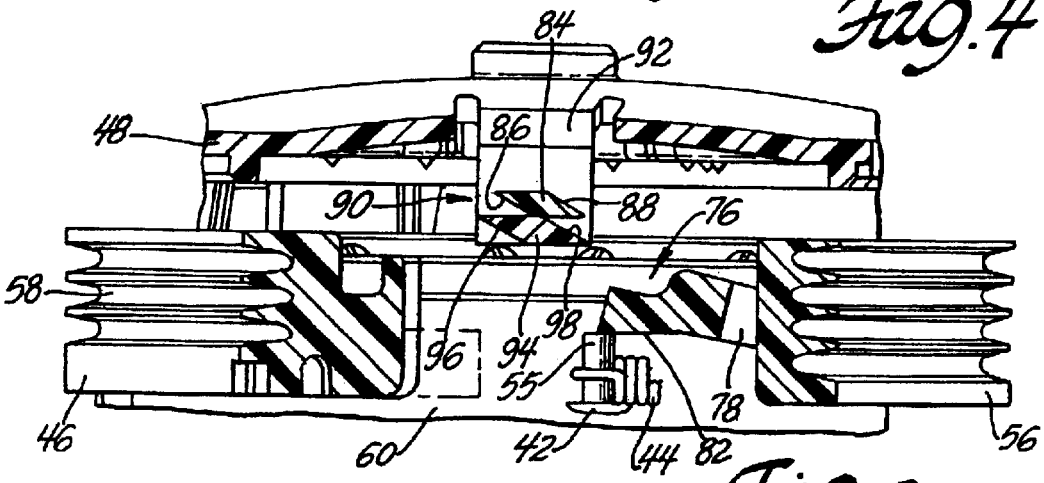
FIG. 6 is a section similar to FIG. 4 showing the cocked cable drums being rotated in the cable drum housing in an opposite direction to release the cocked cable drums so that the cable tensioning spring takes up the slack in the cables.

Once the system is assembled, slack in cables 100 and 102 is taken-up by releasing spring catch 76. Spring catch 76 is released simply by rotating the cocked drums 42 and 46 in the opposite direction. When the cocked drums 42 and 46 are rotated in the opposite direction, spring catch 76 is released. When catch 76 approaches catch release 90 from the right as shown in FIG. 6, outer cam surface 98 of cam 94 engages inner cam follower surface 86 of cam follower 84. This lifts catch 76 away from catch lug 55 and tension spring 44 contracts, rotating drum 42 with respect to drum 46 to take up slack in cables 100 and 102.

Cable drive assembly 24 now operates in the following manner.

As shown in FIG. 2, electric motor 30 is drivingly connected to the input member of electromagnetic clutch 38. For closure, electric motor 30 is energized to drive output shaft 34 and the input member connected to it in the forward direction, i.e. clockwise. At the same time electromagnetic clutch 38 is energized so that the input member drives the friction plate which in turn rotates drum 42 and its cable groove 50 in the forward or clockwise direction. Clockwise rotation about the longitudinal axis 36 winds front cable 100 onto drum 42 to close the sliding door (not shown). As drum 42 is driven clockwise, drum 46 is pulled clockwise via tension spring 44, winding rear cable 102 off of drum 46; with drum 46 being biased counterclockwise by tension spring 44 to maintain tension in cables 100 and 102.

When the sliding door of the van door is closed, electric motor 30 and electromagnetic clutch 38 are deenergized through a suitable control (not shown).

To open the sliding door (not shown), electric motor 30 and electromagnetic clutch 38 are energized to drive output shaft 34 and the friction plate in the rearward direction, i.e. counterclockwise. The friction plate in turn rotates the rear drum 46 and its cable groove in the rearward or counterclockwise direction. Counterclockwise rotation about the longitudinal axis 36 winds rear cable 102 onto drum 46 to open the sliding door (not shown). As drum 46 is driven counterclockwise, tension spring 44 pulls front drum 42 counterclockwise winding front cable 100 out of cable groove and off of drum 42; with drum 42 being biased clockwise by tension spring 44 to maintain tension in cables 100 and 102.

The above description is intended to illustrate a preferred embodiment of the invention rather than to limit the invention. Therefore, it uses descriptive rather than limiting words. Obviously, it's possible to modify this invention from what the description teaches. Within the scope of the claims, one may practice the invention other than as described.

What is claimed is:

1. A cable drive assembly comprising:

a housing, a first drum having a helical cable groove, the first drum being supported in the housing for rotation about an axis;

a second drum having a helical cable groove, the second drum being supported in the housing for rotation about the axis;

a spring having one end connected to the first drum and a second end connected to the second drum biasing the first drum in a first direction of rotation with respect to the second drum when the spring is stressed;

the first drum having a catch that engages a stop of the second drum to prevent rotation of the first drum with respect to the second drum in the first direction of rotation; and the housing having a catch release that cooperates with the catch to release the catch whereby the first drum is rotated with respect to the second drum in the first direction of rotation by the spring when the spring is stressed.

2. The cable drive assembly as defined in claim 1 wherein the catch comprises a flexible arm that is attached to the first drum, and a cam follower that is attached to the flexible arm, and wherein the catch release has a cam that cooperates with the cam follower to release the catch when the first drum is rotated with respect to the housing in the first direction of rotation.

3. The cable drive assembly as defined in claim 2 wherein the cam is shaped so that the cam follower cooperates with the cam to hold the catch in engagement with the stop when the first drum is rotated with respect to the housing in a second direction of rotation opposite the first direction of rotation.

4. The cable drive assembly as defined in claim 3 wherein the spring is a tension spring that is located in an annular spring chamber between the first drum and the second drum and wherein the tension spring is connected to the second drum by a lug of the second drum that serves as the stop for preventing rotation of the drum with respect to the second drum in the first direction of rotation.

5. The cable drive assembly as defined in claim 3 wherein the catch has a stop face that engages the stop to prevent rotation of the first drum with respect to the second drum in the first direction of rotation, and wherein the catch has a ramp leading to the stop face so that the stop face is cammed over and engages the stop when the first drum is rotated with respect to the second drum in the second direction of rotation to cock the drums.

6. The cable drive assembly as defined in claim 3 wherein the cam and the cam follower are bidirectional so that the catch release releases the catch when the first drum is rotated with respect to the housing in the first direction of rotation and maintains the catch in engagement with the stop when the first drum is rotated with respect to the housing in the second direction of rotation.

7. The cable drive assembly as defined in claim 3 wherein the cam has an inner cam surface and an outer cam surface, wherein the cam follower has an inner cam follower surface and an outer cam follower surface, and wherein the outer cam surface of the cam engages the inner cam follower surface of the cam follower to release the catch when the first drum is rotated with respect to the housing in the first direction of rotation, and wherein the inner cam surface of the cam engages the outer cam follower surface of the cam follower to maintain the catch in engagement with the stop when the first drum is rotated with respect to the housing in the second direction of rotation.

8. A cable drive assembly comprising:

a housing, a first drum having a helical first cable groove, the first drum being supported in the housing for rotation about an axis;

a second drum having a helical second cable groove, the second drum being supported in the housing for rotation about the axis;

a tension spring having one end connected to the first drum and a second end connected to the second drum biasing the first drum in a first direction of rotation with respect to the second drum when the spring is in tension;

the first drum having a fixed stop, and a moveable stop, the moveable stop being part of a catch that engages a stop lug of the second drum to prevent rotation of the first drum with respect to the second drum in the first direction of rotation;

the catch having a flexible arm that attaches the moveable stop to the first drum so that the moveable stop moves in an axial direction, and the housing having a cam that cooperates with a cam follower attached to the flexible arm of the catch to move the moveable stop to release the catch whereby the first drum is rotated with respect to the second drum in the first direction of rotation by the tension spring when the spring is in tension.

9. The cable drive assembly as defined in claim 8 wherein the cam is shaped so that the cam follower cooperates with the cam to hold the catch in engagement with the stop lug when the first drum is rotated with respect to the housing in a second direction of rotation opposite the first direction of rotation.

10. The cable drive assembly as defined in claim 9 wherein the tension spring is a coil spring that is located in an annular spring chamber between the first drum and the second drum and wherein the tension spring is connected to the stop lug of the second drum at the second end.

11. The cable drive assembly as defined in claim 10 wherein the cam follower is near a free end of the flexible arm and the movable stop is at the free end of the flexible arm.

12. The cable drive assembly as defined in claim 11 wherein the catch has a ramp leading to the moveable stop so that the moveable stop is cammed over and engages the stop lug when the first drum is rotated with respect to the second drum in the second direction of rotation.

* * * * *